United States Patent [19]

Brundige et al.

[11] 4,305,535

[45] Dec. 15, 1981

[54] DRUM CLOSURE ASSEMBLY

[75] Inventors: Daniel G. Brundige; Donald F. Freund, both of Macon, Ga.; Douglas G. Nelson, Franklin, Ohio

[73] Assignee: The Mead Corporation, Dayton, Ohio

[21] Appl. No.: 188,800

[22] Filed: Sep. 19, 1980

Related U.S. Application Data

[63] Continuation-in-part of Ser. No. 78,116, Sep. 24, 1979, Pat. No. 4,252,265.

[51] Int. Cl.[3] ..... B65D 41/16

[52] U.S. Cl. ..... 229/5.7; 220/306

[58] Field of Search ..... 229/5.5, 5.6, 5.7, 5.8, 229/43; 220/306, 307, 308

[56] References Cited

U.S. PATENT DOCUMENTS

| | | | |
|---|---|---|---|
| 3,297,193 | 1/1967 | Stevens, Jr. | 220/306 |
| 3,358,875 | 12/1967 | Ekstrom | 220/306 |
| 3,843,013 | 10/1974 | Brooks, Jr. | 220/306 X |
| 3,880,288 | 4/1975 | Hunter | 220/306 X |
| 4,030,850 | 6/1977 | Hyde | 229/308 X |
| 4,042,169 | 8/1977 | Burgdorf | 229/43 |
| 4,094,460 | 6/1978 | Scanga et al. | 229/5.8 X |
| 4,166,548 | 9/1979 | Crisci | 220/308 |
| 4,182,475 | 1/1980 | Freund | 229/5.7 |

FOREIGN PATENT DOCUMENTS

| | | | |
|---|---|---|---|
| 261090 | 3/1964 | Australia | 229/5.8 |

*Primary Examiner*—Herbert F. Ross

*Attorney, Agent, or Firm*—Stephen H. Cagle; C. N. Shane, Jr.; Wilson G. Palmer

[57] ABSTRACT

An improved drum closure assembly which includes a ring member and a cover member, the cover member being cooperatively sized for a fitted, overlapping relationship with the ring member. The ring member comprises outer and inner ring portions which are angularly displaced from parallel to one another. The cover member includes a top cover member and an annular wall member designed to about the outer ring portion of the ring member and to seal the assembly when in use.

3 Claims, 12 Drawing Figures

DRUM CLOSURE ASSEMBLY

CROSS REFERENCE TO RELATED APPLICATIONS

This application is a continuation-in-part of commonly assigned co-pending application, Ser. No. 078,116, filed Sept. 24, 1979, now U.S. Pat. No. 4,252,265.

BACKGROUND OF THE INVENTION

1. Subject Matter

This invention relates to improved drum closure assemblies and to the drum containers produced by their use.

2. Prior Art

This invention relates to an improved drum closure assembly and a method for securing the closure assembly to the open or top end of a drum body.

The drum which will be referred to in this application is a fibreboard drum of tubular form, which may be of laminated or nonlaminated structure. This type of fibreboard drum and the method for manufacturing same are disclosed in U.S. Pat. No. 3,039,371 to Leibreich. The primary advantage of fibreboard drums is that they can be manufactured in tubular form and then shipped or stored in flat form, thus presenting a substantial savings in terms of space usage. For the purpose of this application, these fibreboard drums are sometimes referred to as "KD Drums", the KD standing for "Knocked Down" which is simply descriptive of the condition in which the tubular fibreboard drums can be shipped and stored.

As can be appreciated, these drums are available in a variety of sizes, shapes, thicknesses and for a number of purposes. As explained above, the fibreboard drum may be of laminated or nonlaminated structure. If laminated, inner and outer plys are preferably of conventional kraft paper which may be either wet or dry finished. So, to, if the fibreboard is of nonlaminated construction, its opposite surfaces are wet or dry finished as may be required. In either construction, the surface of the fibreboard is preferably impervious to liquids, and the inner surface or in some instances both the inner and outer surfaces are lined with a protective coating of any conventional composition.

The drum containers are frequently used for packing such material as asphalt, rubber and the like which is poured in place in a liquid condition to be hardened upon cooling. For packaging such material, the interior surface of the drum is lined with any conventional coating material, i.e., silicone, polyethylene, polypropylene, that is commonly used for the purpose of rendering the drum impervious to absorption from the contents contained within the drum or moisture from outside ambient conditions. The tubular form is made from a fibreboard blank with its side edges overlapped and joined to any desired extent for forming the lap joint extending lengthwise of the tubular form. Adhesives, staples or other fastening means can be used to join the side edges.

Recently, it has been shown that other materials such as food slurries and the like can be conveniently packaged in fiberboard drums for shipping and storage. Other uses to which the fibreboard drums can be placed are obvious to one of ordinary skill in the art. In particular, there are in reality no limitations on the materials which can be retained or shipped by the fibreboard drums of this invention. In many instances, specific end uses require modifications of the innermost protective or barrier coating of the fibreboard to meet relevant Food and Drug Administration guidelines or the like, but in no instances are the technical problems with the formulation and use of such coatings serious. Therefore, for purposes of this application, it will be assumed that the improved fibre drum closure assembly can be used with any such material and the specific use of the drum or the particular material to be contained by the drum are not alleged to be inventive features herein.

Logically, it has been found that the effective commercial use of the fibre drum disclosed hereinabove requires both a bottom closure member and a top closure member. It has been known to use a metal disk as the bottom for drum members. The use of such bottom members and an apparatus for producing a container having a tubular fibreboard body portion and a metal disk bottom member is described by U.S. Pat. No. 3,057,265 issued to Leibreich in 1962. In this patent it is described how drums can be formed and a metal bottom seamed onto the bottommost edge of the tubular container member. In this fashion a fibreboard drum is formed having a sealed bottom member but having no top.

There have been a variety of previous attempts in the use and manufacture of a top closure member for use with fibreboard drums. The previous attempts to produce such drums consistently suffer from disadvantages. Among these are that the top member did not provide a good seal and, therefore, could not be used for materials which could leak or which could be spoiled or otherwise disadvantages by exposure to the atmosphere. Secondly, many of the prior art attempts to form a top closure member did not have stacking capabilities which provide a substantial advantage in the shipping and storage of the fibreboard drums once they have been filled. Third, many of these prior art top closure members required actual assembly on a machine such as a seaming machine. This is, of course, extremely cumbersome, expensive and not time efficient.

It has further been shown that when fibre drums are used for food packaging and shipped in stacked configuration that grooves used for stacking purposes are convenient receptacles for dirt, water and other material which may find its way into the packaged food when the top is removed from the drum. In this regard, see commonly assigned U.S. Pat. No. 4,182,475, issued Jan. 8, 1980 to Freund to a similar drum closure assembly. Finally, the prior closure members either did not hold the fibreboard drum round for purposes of filling. As can be appreciated, it is necessary for the fibreboard drum to be held in a substantially round configuration during filling so that the maximum amount of material can be inserted into each drum. The drum closure assembly of this invention solves all of these and other problems which have been appreciated by the prior art.

Other patents of which the applicants are aware which deal with the concept of closing drums include:

U.S. Pat. No. 801,382 to Keyes (1905);
U.S. Pat. No. 1,528,489 to Snell (1926);
U.S. Pat. No. 1,725,525 to Knodolf (1929);
U.S. Pat. No. 3,054,548 to Scott (1962);
U.S. Pat. No. 3,297,193 to Stevens (1967);
U.S. Pat. No. 3,358,875 to Ekstrom (1967);
U.S. Pat. No. 3,843,013 to Brooks (1974);
U.S. Pat. No. 3,880,288 to Hunter (1975);
U.S. Pat. No. 4,030,850 to Hyde (1977);

U.S. Pat. No. 4,042,169 to Burgdorf (1977);
U.S. Pat. No. 4,094,460 to Scanga et al. (1978);
U.S. Pat. No. 4,166,548 to Crisci (1979);
Australian Pat. No. 261, 090 to Hosking (1964).

Of these additional patents, Scanga et al., U.S. Pat. No. 4,094,460, represents an effort to provide a closure assembly which can be heat sealed. Such heat sealing devices require heat sealable discs and the like and in general must withstand severe pressure and temperature gradients. For this reason, oftentimes the prior art requires an outward expansion of the drum edge as is shown more particularly by U.S. Pat. No. 4,094,460. This is a disadvantage to standard KD drum production as such a requirement severely limits the use of mass production techniques and limits the "knocked-down" configuration of the drums themselves. Heat sealing containers additionally require heat sealable surfaces which severely limits the use of the appropriate guide means and locking means. In addition, the expanded groove shown by the prior art severely limits the production capabilities of injection molding apparatus which is traditionally used in the manufacture of this type of apparatus.

SUMMARY OF THE INVENTION

Figure 1:
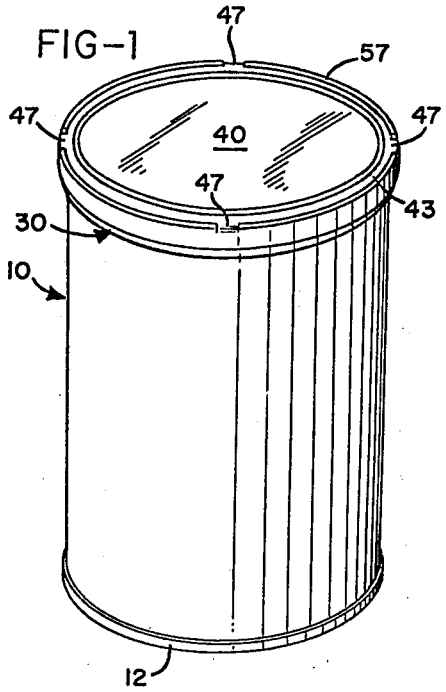
FIG. 1 is a perspective view showing the fibre drum of this invention with the drum closure assembly locked in place.

This invention relates to an improved drum closure assembly which comprises a ring member and a cover member. The ring member includes an outer ring portion and an inner ring portion which is laterally displaced from parallel to the outer ring portion. A connecting portion fixedly joins the inner and outer ring portions and an elongated groove is defined in said ring member, the groove being receptive to the uppermost edge of a drum. The cover member is cooperatively sized for a fitted, overlapping relationship with the ring member and includes a top cover member and an annular wall member. The annular wall member is continuous and projects downwardly from the top cover member. The circumference of the outermost edge of the outer ring portion of the ring member is sized to provide a sealing fit with the inner surface of the annular wall member. Drainage means are present which permit the flow of accumulating liquid from the cover member.

DESCRIPTION OF THE PREFERRED EMBODIMENTS

For the purposes of promoting an understanding of the principles of this invention, reference will now be made to the embodiment illustrated in the drawings and specific language will be used to describe the same. It will nevertheless be understood that no limitation of the scope of the invention is thereby intended, such alterations and further modifications in the illustrated device, and such further application of the principles of the invention as illustrated therein contemplated as would normally occur to one skilled in the art to which the invention relates.

The fibreboard drum 10 is made from wet strength Kraft and has a wall thickness of 0.01 inches to 0.09 inches. Preferably the wall thickness, including all laminate layers, is from about 0.015 inches to about 0.075 inches. A most preferred range for wall thickness is from about 0.019 inches to about 0.045 inches. For commercial purposes it has been found that the diameter of the fibreboard drum should be from about 5 inches to about 24 inches and the height of the drum up to about 72 inches. Dimensions substantially larger and smaller than these can be very conveniently used depending upon the product to be packaged and on available apparatus for assembling and seaming bottoms onto such drums.

The fibreboard drums 10 are in general tailored for a specific purpose and are most preferably used for carrying materials that are poured in hot, liquid form and then solidified, such as asphalt, adhesives, resins, and waxes. The fibreboard drums 10 are, however, equally adaptable and, in fact, have shown great utility in the storage of materials in cold or frozen form. The interior 11 of the fibre drums 10 can be specially coated to meet the release and/or protective requirements of any product it carries. Coatings can be used to insure greaseproofness, moisture and water proofness among other characteristics. Regulatory Agency, i.e., FDA., approval is sometimes used as a reason for coating the interior of drums. Coatings can in some instances be eliminated if plastic inner bags are to be used in the fibre drum. For tacky products such as asphalt, resin, adhesives, etc., coatings can be used to give positive release from the drum wall, even when the drum is filled at high temperatures. As has been stated hereinabove, the specific size or coated features of the drum 10 of this invention is not alleged to be an inventive feature herein. Rather, it is merely stated that the drum 10, metal bottom 12 and drum closure assembly 20 must be cooperatively sized to form an effective container. It should also be noted that the improved drum closure assembly 20 can be used equally effectively for both top and bottom in certain instances. It should be understood that the references herein to a metal bottom being seamed to the fibre drum refers to the preferred application and is not intended as a limitation on the scope of application of drum closure assemblies.

A first element in the drum closure assembly 20 is ring member 30. In describing ring member 30 attention is drawn specifically to FIGS. 2 and 5 of the drawings. Ring member 30 consists of an outer ring portion 31, an inner ring portion 32 and a connection portion 33. In the most preferred embodiment of this invention, ring member 30 is made from a moldable, resiliently flexible material such as polyethylene or other plastic material, and portions 31, 32 and 33 form a continuous structure.

The positioning of outer ring portion 31, inner ring portion 32 and connecting portion 33 define an elongated groove 34. Elongated groove 34 is continuous throughout the circumference of ring member 30 and is preferably funnel shaped at the open end of groove 34 to provide means for guiding drum 10 into groove 34. Specifically, it is noted that the mouth 36 of groove 34 is substantially wider than the innermost recessed portion 37 of groove 34. In the preferred embodiment of this invention, groove 34 is perpendicular to a plane 56 (as illustrated by line 56 in FIG. 11). This perpendicular arrangement is significant in that the unique combination of fibreboard drum and closure assembly provides the appropriate retention capability as opposed to prior art devices which required flared drum tops and correspondingly flared receptive grooves and like means for retaining the closure assembly on the drum member.

Figure 5:
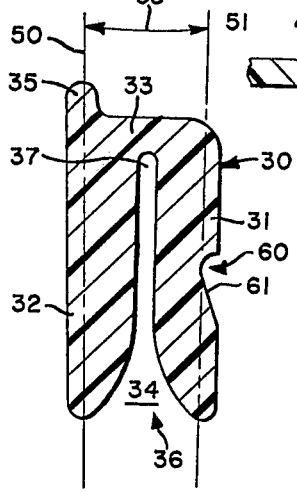
FIG. 5 is a cross-sectional view of the ring member of this invention showing one locking means embodiment.

It is important to note that in the preferred embodiment of this invention inner ring portion 32 is angularly displaced from outer ring portion 31, although in other embodiments, angular displacement is not necessary. Referring now to FIG. 5, it is seen that line 50 through inner ring portion 32 is angularly displaced from parallel with line 51 through outer ring portion 31 by angle 55. The angular displacement 55 of portions 31 and 32 is less than about 10 degrees and portions 31 and 32 may in fact be parallel to one another. The primary reason for such angular displacement is to facilitate removal of the ring member 30 from its mold during the manufacturing operation. In addition, outer ring portion 31 has means for cooperative action with locking means 45 found on annular wall member 42. These means are generally designated by the number 60 and are discussed more fully hereinafter. A tight fit between groove 34 and drum 10 results from portions 37 of groove 34 being narrower than the thickness of drum 10. This provides an interference fit between the two members.

In the most preferred embodiment of this invention, connection portion 33 of ring member 30 also contains ring guide member 35. Ring guide member 35 extends upwardly from connecting member 33 to form a continuous ridge aiding in the positioning of cover member 40 into fitted relationship with ring member 30. As shown in the drawing guide member 35 is continuous although it has been demonstrated that discontinuous projections are acceptable substitutes. Guide member 35 also functions as stacking means for drums 10 which have not been filled. In this fashion, ring member 30 can be placed onto drum 10 and then the drums can be conveniently stacked while awaiting filling.

The second primary element of drum closure assembly 20 is the cover member 40. In the preferred embodiment of this invention, cover member 40 consists of a top cover member 41 and an annular wall member 42. Although members 41 and 42 are treated separately, in the most preferred embodiment of this invention, both members would be molded into a continuous cover member 40 using resiliently flexible material identical to that used in making ring member 30.

Figure 2:
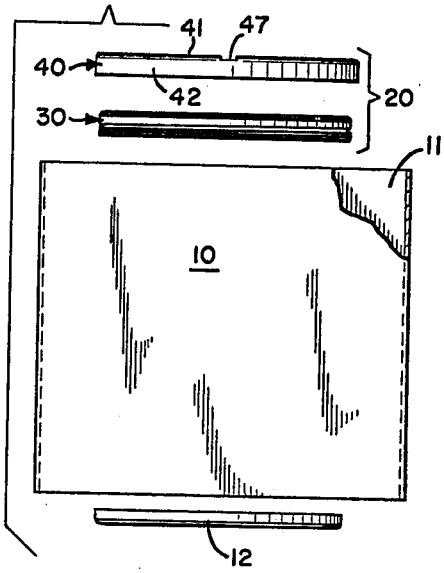
FIG. 2 is an exploded view showing the elements of the fibre drum, (partially in section) metal bottom and drum closure assembly elements of this invention.
Figure 3:
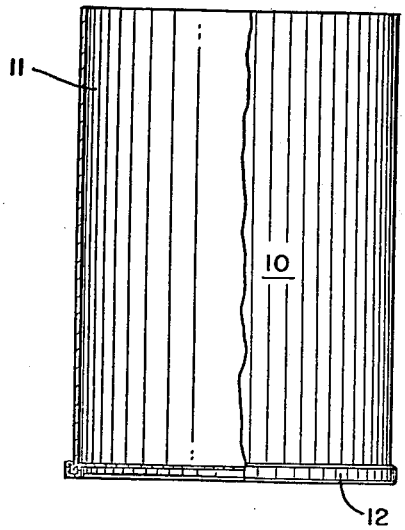
FIG. 3 is a front elevation of a fibre drum of this invention with seamed metal bottom in place. Portions of this figure have been cut away to show the relationship between the fibreboard drum and the seamed metal bottom.
Figure 4:
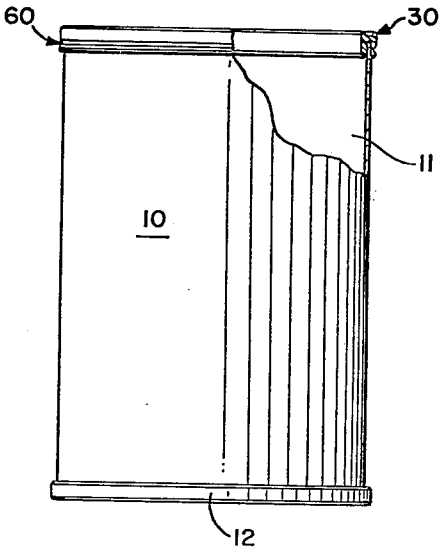
FIG. 4 is a front elevation identical to FIG. 3 except a portion of the drum closure assembly is shown locked in place with portions thereof partially cut away.
Figure 7:
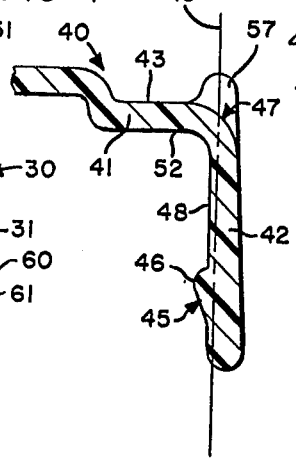
FIG. 7 is a cross-sectional view of the cover member of this invention.

Referring now more particularly to FIGS. 2 and 7, the cover member 40 will be described. The top cover member 41 comprises a substantially circular inner portion for the drum closure assembly 20 and is continuous and in reality forms the true top to retain the contents of drum 10 during storage and shipping.

Figure 6:
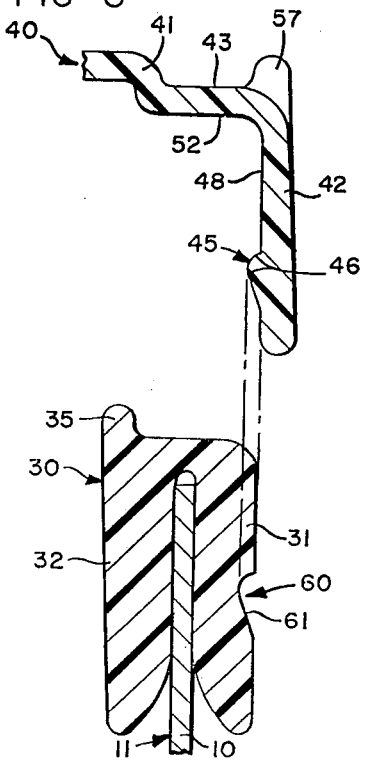
FIG. 6 is a cross-sectional view of the cover member and ring member of this invention prior to insertion.
Figure 9:
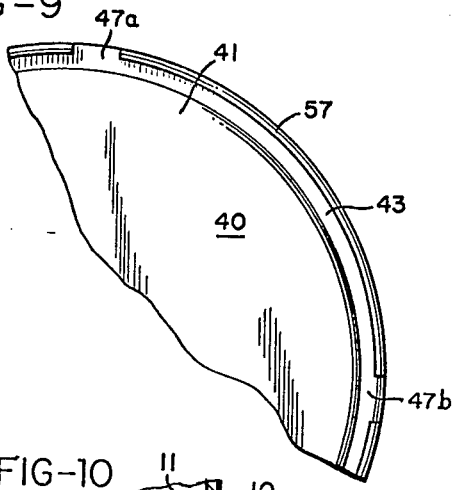
FIG. 9 is a top view of a portion of the cover member of this invention.

Annular wall member 42 projects downwardly from the inner or bottom surface 52 of top cover member 41. As is shown more particularly in FIG. 6 the inner surface 48 of annular wall member 42 is substantially perpendicular to a plane defined by said top cover member 41 (shown as 56 in FIG. 11). In particular, such a perpendicular line is illustrated by the member 49 in FIG. 7.

Figure 11:
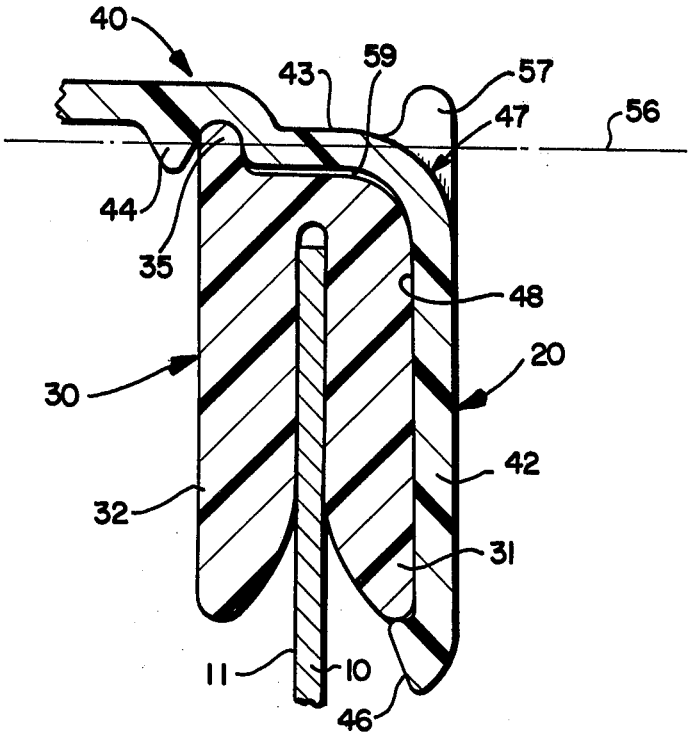
FIG. 11 is a cross-sectional view of the most preferred embodiment of this invention.
Figure 12:
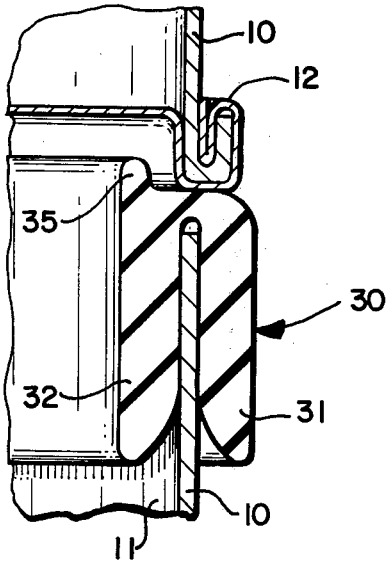
FIG. 12 is a cross-sectional view of stacked unfilled drums of this invention with the closure assembly embodiment of FIG. 11.

In the most preferred embodiment of this invention, a cover guide member 44 projects downwardly from top cover member 40. Member 44 is mated with guide member 35 found on ring member 30. As with guide member 35, cover guide member 44 can be continuous or discontinuous around the circumference of cover member 40. As can be seen more specifically by reference to FIG. 11, member 44 provides a guide for aligning cover member 40 when it is being placed over ring member 30. In the most preferred embodiments of this invention, a sealing fit is formed between members 35 and 44. Additionally, in the most preferred embodiment of this invention, again as shown in FIG. 11, an air space 59 is defined between ring member 30 and cover member 40 which aids greatly in the removal of top member 40 from ring member 30. This is especially true when the contents of the container contract after filling causing a negative pressure to be present in said drum. This negative pressure can cause a great deal of difficulty in removing the top if an appropriate air space is not provided. This air space is specifically distinct from prior art heat sealed canisters, containers, drums and the like.

Found close to or at the anterior end of annular wall member 42 are locking means 45. Locking means 45 is found in a variety of configurations including the configurations shown in the preferred embodiments illustrated in FIGS. 6 through 11. In the most preferred embodiment of this invention, the locking means 45 take the form of locking portion 46 projecting inwardly from the surface 48 of annular wall member 42. The precise configuration of locking portion 46 is not critical as it may be a continuous wall, a series of locking tabs or other configuration which functions to maintain a fixed relationship between the cover member 40 and ring member 30. Locking portion 46 is sometimes referred to as locking extension member 46. In the most preferred embodiment of this invention as illustrated more particularly by FIG. 11 locking means 45 comprises an extension 46 of the anterior end of annular wall member 42. This extension then overlaps and fixedly engages the anterior-most surface of ring member 30 when in actual use.

Figure 8:
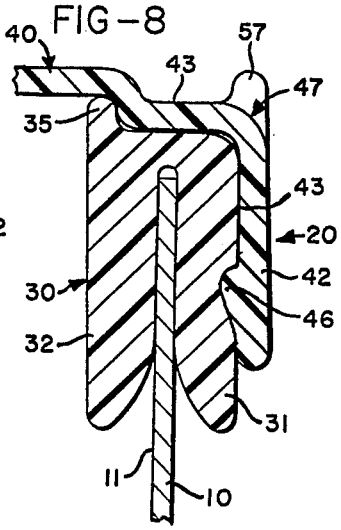
FIG. 8 is a cross-sectional view of the drum closure assembly in locked position.

As is shown more particularly by FIG. 5 in certain embodiments, outer ring portion 31 has cooperative locking means 60. These cooperative locking means 60 take any form which is functionally effective to work in cooperation with the locking means 45 to hold cover member 40 fixedly in its designed overlapping relationship with ring member 30. In the embodiment of locking extension member 46 shown in FIGS. 6 and 8, the cooperative locking means 60 would take the form of a locking groove 61 in outer ring member 31. In this fashion and as is shown by FIG. 8, the locking extension number 46 fixedly engages locking groove 61 to lock said cover member into said ring member. The various locking means may sometimes be referred to descriptively hereinafter as the male or female members of the locking means.

Figure 10:
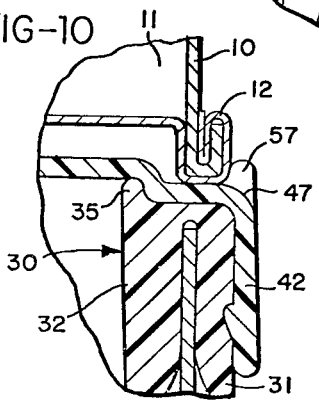
FIG. 10 is a cross-sectional view of stacked fibre drums using the drum closure assembly of this invention.

In the most preferred embodiment of this invention, top cover member 41 of cover member 40 also contains nesting means 43. Nesting means 43 in most instances is a groove which is receptive to the seamed metal bottom of a stacked drum 10. See especially FIGS. 10 and 11 showing stacked drums in nesting configuration. Other nesting configurations and nesting means for top cover member 41 are readily within the ambit of this invention. The grooved nesting means described herein and illustrated by the drawings are merely for purposes of clarification.

It is a further characteristic of the most preferred embodiment of this invention that drainage means 47 are provided. In the specific embodiment illustrated by the drawings, and especially FIGS. 6, 8 and 9, it is shown that the drainage means 47 are interruptions or openings 47*a* and 47*b* in the continuous nature of outermost wall 57 of nesting groove 43. In the illustrated embodiment four such interruptions or openings 47*a* et seq. are recited, said openings being spaced laterally around the circumference of wall 57. It should, however, be understood that the precise number, shape or configuration of such openings is determined by the functional necessity of the conditions of storage or shippage. It should be noted that the drum closure assembly of this invention with nesting means 43 and drainage means 47 is especially useful in the packaging and shipping of food materials where sanitary conditions are imperative. It is, however, important that the drainage means 47 permit the flow or escape of accumulating liquid from the cover member 40 and nesting means 43.

As can be appreciated from the above description of ring member 30 and cover member 40 in the most preferred embodiment of this invention, both members are constructed using a resiliently flexible plastic material. Any of the currently available polymeric materials are suitable for these purposes with the final definition of best materials being dependent on the end use to which the drum closure assembly is to be placed and ultimately on the material to be contained by drum 10. It is important that the ring member 30 and cover member 40 be slightly flexible to permit use of locking means 45. In this fashion, a tight lock can be achieved as is illustrated by the drawings and the cover can be conveniently removed without the necessity for special tools or without breaking the cover member during the removal process.

The particular configuration of locking means is ultimately dependent on the tightness of the seal desired and, therefore, on the material to be contained by drum 10. Configurations and locking means other than those shown in the drawings and described hereinabove are readily suitable to the drum closure assembly of this invention.

Although the foregoing has described the use of a drum closure assembly which is designed to be opened, it is also possible that such an assembly could be permanently sealed. The permanent seal could be effected by a machining of cover member 40 and ring member 30 to tight dimensioned standards or by the use of an adhesive to join cover member 40 and ring member 30. These and other options remain equally viable in the use of the drum closure assembly 20 of this invention and ultimately depend on the final product and conditions of storage and shipping.

It is important to note here that the circumference of the outermost edge of the outer ring portion 31 is sized to provide a sealing fit with the innermost edge 48 of annular wall member 42. The sealing fit between ring member 30 and cover member 40 can result from the tight fit between the aforementioned outer and inner surfaces, respectively, or can result from the sealing relationship of locking means 45. In the most preferred embodiment of this invention, the seal would result from a tight fit between both the inner and outer surfaces as well as between the respective locking members. To facilitate such a sealing fit, it is entirely possible that the circumference of the outermost edge of the outer ring portion 31 is the same as or slightly greater than the circumference defined by the innermost edge 48 of annular wall member 42.

This permits convenient placement of cover member 40 into its designed fitted, overlapping relationship with ring member 30. The insertion of cover member 40 over ring member 30 places a seal between annular wall member 42 and inner ring portion 32, the seal resulting from the interference fit between groove 34 and drum 10. Thus the insertion of cover member 40 not only seals the drum closure assembly but also secures the drum closure assembly to the drum 10. It is important to note here that both of these sealing features can be conveniently accomplished without the use of adhesives. In practice the seal between cover member 40 and ring member 30 is potentially sanitary which makes this available as a food packaging material.

Other advantages enjoyed by the drum closure assembly 20 of this invention include the fact that the drum closure assembly can be utilized and assembled separate from seaming machines normally necessary in the use of fibre drums with metal bottoms.

In practice the drum forming assembly of this invention would be used by first assembling a drum 10 and and seaming a metal bottom 12 onto said drum. At this time, the ring member 30 would be inserted onto the drum 10 by inserting the uppermost and unsealed edge of drum 10 into elongated groove 34. At that time, cover member 40 could be inserted over ring member 30 and until locking means 45 actively engage cooperative locking means 60. At this time, the entire assembly is sealed and the drum closure assembly 20 is fixedly attached to the drum 10 by pressure between inner ring portion 32 and outer ring portion 31.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A drum closure assembly comprising:

(A) a ring member made from resiliently, flexible plastic material, said ring member including:

(i) an outer ring portion;

(ii) an inner ring portion laterally displaced from said inner ring portion, said inner ring portion being less than about 10 degrees angularly displaced from parallel to said outer ring portion;

(iii) a connecting portion fixedly joining said inner ring portion to said outer ring portion;

(iv) an elongated groove being defined by said inner ring portion, said outer ring portion and said connecting portion, said groove being substantially perpendicular to a plane defined by said connecting portion;

(v) a ring guide member, said member being suitable for nesting means for unfilled drums; and (B) a cover member, said cover member being cooperatively sized for a fitted, overlapping relationship with said ring member, said cover member including:

(i) a top cover member;

(ii) an annular wall member projecting downwardly from said top cover member, the circumference of the outermost edge of said outer ring portion of said ring member being smaller than the circumference defined by the inner surface of said annular wall member, said annular wall member being substantially perpendicular to a plane defined by said top cover member;

(iii) nesting means, said nesting means comprising a groove in the outermost circumferential portion of said top cover member, said groove being receptive to cooperating nesting means found at the bottom of an assembled drum;

(iv) drainage means comprising one or more interruptions in the outermost wall defining said groove of said nesting means, said interruptions being contoured so as to permit the free flow of accumulating liquid from said cover member;

(v) a cover guide member, said member being suitable for properly aligning said cover member and said ring member;

(C) locking means comprising a locking member extending inwardly from the innermost circumference of said annular wall member, said locking member being fixedly engaged by said ring member when said cover member is in a fitted, overlapping relationship with said ring member.

2. A drum container comprising:

(A) a fiber drum having a closed end and an open end;

(B) a closure assembly sealed thereon including a ring member, said ring member including:

(i) an outer ring portion;

(ii) an inner ring portion laterally displaced from said inner ring portion;

(iii) a connecting portion fixedly joining said inner ring portion to said outer ring portion;

(iv) an elongated groove being defined by said inner ring portion, said fiber drum being frictionally engaged by said groove, said groove being substantially perpendicular to a plane defined by said connecting portion; and (v) a ring guide member, said member being suitable for nesting means for unfilled drums.

(C) a cover member, said cover member overlapping said ring member and including:

(i) a top cover member;

(ii) an annular wall member projecting downwardly from said top cover member, the circumference of the outermost edge of said outer ring portion of said ring member being smaller than the circumference defined by the inner surface of said annular wall member, said annular wall member being substantially perpendicular to a plane defined by said top cover member;

(iii) nesting means, said nesting means comprising a groove in the outermost circumferential portion of said top cover member, said groove being receptive to cooperating nesting means found at the bottom of an assembled drum;

(iv) drainage means comprising one or more interruptions in the outermost wall defining said groove of said nesting means, said interruptions being contoured so as to permit the free flow of accumulating liquid from said cover member;

(v) a cover guide member, said member properly aligning said cover member and said ring member; and (D) locking means comprising a locking member extending inwardly from the innermost circumference of said annular wall member, said locking member being fixedly engaged by said ring member.

3. The drum closure of claim 1 or 2 wherein said cover member further includes a cover guide member, said cover guide member being suitable for properly aligning said cover member and said ring member.

* * * * *